US010193247B1

(12) United States Patent
Glick et al.

(10) Patent No.: US 10,193,247 B1
(45) Date of Patent: Jan. 29, 2019

(54) ELECTRICAL CONTACT SPRING WITH EXTENSIONS

(71) Applicant: Lear Corporation, Southfield, MI (US)

(72) Inventors: Michael Glick, Farmington Hills, MI (US); Tulasi Sadras-Ravindra, Canton, MI (US); Deborah Probert, Farmington Hills, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/812,383

(22) Filed: Nov. 14, 2017

(51) Int. Cl.
*H01R 11/22* (2006.01)
*H01R 4/48* (2006.01)

(52) U.S. Cl.
CPC ..... *H01R 11/22* (2013.01); *H01R 4/48* (2013.01)

(58) Field of Classification Search
CPC ..... H01R 13/18
See application file for complete search history.

(56) References Cited

U.S. PATENT DOCUMENTS 4,453,799 A 6/1984 Inoue
4,540,235 A * 9/1985 Lolic ..... H01R 13/11 439/839
4,932,877 A * 6/1990 Zinn ..... H01R 13/18 439/839
4,934,965 A * 6/1990 Buddrus ..... H01R 13/113 439/845
5,334,058 A * 8/1994 Hotea ..... H01R 13/18 439/839
5,437,566 A * 8/1995 Zinn ..... H01R 13/113 439/839
5,695,368 A * 12/1997 Joly ..... H01R 13/432 439/748
5,833,500 A * 11/1998 Mahon ..... H01R 13/113 439/852
5,863,225 A * 1/1999 Liebich ..... H01R 13/18 439/845
5,868,590 A * 2/1999 Dobbelaere ..... H01R 13/18 439/839
5,938,485 A * 8/1999 Hotea ..... H01R 13/18 439/839
5,951,336 A * 9/1999 Seko ..... H01R 13/432 439/745
5,954,548 A * 9/1999 Stabroth ..... H01R 13/434 439/748
6,203,385 B1 * 3/2001 Sato ..... H01R 13/113 439/852

(Continued)

*Primary Examiner* — Ross N Gushi
(74) *Attorney, Agent, or Firm* — MacMillan, Sobanski & Todd, LLC

(57) ABSTRACT

An electrical terminal assembly includes a contact member. The contact member has a contact base. A plurality of contact arms extend from the contact base in an arm direction. The electrical terminal assembly includes a spring member supported on the contact member. The spring member includes a spring base. A plurality of spring arms extend from the spring base in the arm direction. The spring arms engage the plurality of contact arms. The spring member includes a shroud. The shroud extends in the arm direction around and beyond the contact arms. A shroud extension extends from the shroud opposite the arm direction. The shroud extension engages the contact base.

20 Claims, 7 Drawing Sheets

(56) References Cited

U.S. PATENT DOCUMENTS 6,283,803 B1 * 9/2001 Sato ..... H01R 13/113 439/852
6,872,103 B1 * 3/2005 Flieger ..... H01R 13/18 439/752.5
7,252,559 B1 * 8/2007 Morello ..... H01R 4/185 439/843
7,595,715 B2 * 9/2009 Pavlovic ..... H01H 85/0417 337/187
7,876,193 B2 1/2011 Pavlovic et al.
7,892,050 B2 * 2/2011 Pavlovic ..... H01R 9/245 439/250
7,909,663 B1 * 3/2011 Bouffet ..... H01R 13/18 439/212
7,988,505 B2 * 8/2011 Hotea ..... H01R 13/187 439/852
8,182,299 B2 * 5/2012 Schrader ..... H01R 13/18 439/839
8,366,497 B2 * 2/2013 Glick ..... H01R 9/245 439/839
8,449,338 B2 * 5/2013 Gong ..... H01R 13/18 439/682
8,475,220 B2 * 7/2013 Glick ..... H01R 13/113 439/839
8,827,754 B2 * 9/2014 Lee ..... H01R 13/113 439/843
8,992,270 B2 * 3/2015 Glick ..... H01R 13/18 439/839
8,998,655 B2 * 4/2015 Glick ..... H01R 13/18 439/839
9,011,186 B2 * 4/2015 Wirth ..... H01R 13/112 439/843
9,142,902 B2 * 9/2015 Glick ..... H01R 13/18
9,190,756 B2 * 11/2015 Glick ..... H01R 13/18
9,293,852 B2 * 3/2016 Glick ..... H01R 3/20
9,300,069 B2 3/2016 Morello et al.
9,379,470 B2 * 6/2016 Glick ..... H01R 13/18
9,437,974 B2 * 9/2016 Glick ..... H01R 13/642
9,444,205 B2 * 9/2016 Rangi ..... H01R 13/658
9,450,331 B1 * 9/2016 Luo ..... H01R 13/18
9,515,403 B2 * 12/2016 Hirakawa ..... H01R 4/184
9,525,254 B2 * 12/2016 Chen ..... H01R 7/02
9,548,553 B2 * 1/2017 Glick ..... H01R 13/113
9,711,926 B2 * 7/2017 Belanger, Jr. ..... B33Y 80/00
9,799,980 B2 * 10/2017 Jakoplic ..... H01R 4/185
9,847,591 B2 * 12/2017 Glick ..... H01R 13/18
9,905,953 B1 * 2/2018 Pavlovic ..... H01R 13/187
2001/0019924 A1 * 9/2001 Heimueller ..... H01R 13/114 439/851
2009/0053941 A1 * 2/2009 Stuklek ..... H01R 12/724 439/825
2010/0216354 A1 * 8/2010 Copper ..... H01R 13/18 439/805
2010/0216355 A1 * 8/2010 Copper ..... H01R 13/187 439/805
2010/0323563 A1 * 12/2010 Pavlovic ..... H01R 9/245 439/839
2011/0076901 A1 * 3/2011 Glick ..... H01R 9/245 439/839
2012/0129407 A1 * 5/2012 Glick ..... H01R 13/113 439/817
2014/0030934 A1 * 1/2014 Wirth ..... H01R 13/112 439/816
2014/0087601 A1 * 3/2014 Glick ..... H01R 13/187 439/834
2014/0087602 A1 * 3/2014 Glick ..... H01R 13/187 439/834
2014/0227915 A1 * 8/2014 Glick ..... H01R 13/113 439/856
2014/0235113 A1 * 8/2014 Glick ..... H01R 13/114 439/834
2014/0273659 A1 * 9/2014 Glick ..... H01R 13/113 439/676
2015/0038000 A1 * 2/2015 Glick ..... H01R 13/113 439/370
2015/0038024 A1 * 2/2015 Glick ..... H01R 13/18 439/862
2015/0079859 A1 * 3/2015 Glick ..... H01R 3/20 439/891
2015/0229056 A1 * 8/2015 Morello ..... H01R 13/113 439/370
2015/0255912 A1 * 9/2015 Natter ..... H01R 13/18 439/589
2015/0255924 A1 * 9/2015 Glick ..... H01R 13/18 439/733.1
2015/0303593 A1 * 10/2015 Ono ..... H01R 12/728 439/850
2015/0303604 A1 * 10/2015 Rivera ..... H01R 13/113 439/817
2016/0226177 A1 * 8/2016 Chen ..... H01R 13/18
2016/0233635 A1 * 8/2016 Chen ..... H01R 13/112
2016/0344129 A1 * 11/2016 Jakoplic ..... H01R 4/185

* cited by examiner

ELECTRICAL CONTACT SPRING WITH EXTENSIONS

BACKGROUND OF THE INVENTION

This invention relates in general to a spring for use with a female electrical terminal. More specifically, this invention relates to a spring with a stabilizing feature for use with a female electrical terminal.

Electrical terminals commonly include a female terminal and a corresponding male terminal that may be mated to establish an electrical connection. Male electrical terminals are manufactured in various shapes, including pins and blades, and female electrical terminals are manufactured in complementary shapes that can engage the appropriate male terminal. Female terminals often include a contact portion with multiple contact arms that press onto sides of the male terminal. It is known to provide a female terminal with a spring member to increase the compression force between the male terminal and the female terminal. An example of one such spring is shown in U.S. Pat. No. 7,892,050. The spring member is typically made of a material that, compared to the material of the contact portion, has inferior electrical conductivity but is less susceptible to relaxation. The spring maintains the desired compression force without requiring that the size of the contact portion be increased and allows the female terminal to maintain a desired contact area with the male terminal, even when the temperature of the female terminal increases.

It is also known to provide a female terminal with front end protection. An example of front end protection is shown in U.S. Pat. No. 9,548,553. The terminal shown in the '553 patent includes a spring member with integral front end protection. The spring engages contact arms to maintain a compression force between the female terminal and a corresponding male terminal, similar to the spring member described in the '050 patent. Additionally, the spring member includes a cage that extends around and past the contact arms. The cage protects the contact arms from damage during shipping, handling, installation, and use. Because the cage is part of the spring member, no additional pieces are added to the female terminal. It would be desirable to have a spring with features that make is easier to properly position on the contact portion.

SUMMARY OF THE INVENTION

The invention relates to an electrical terminal assembly. The electrical terminal assembly includes a contact member. The contact member has a contact base. A plurality of contact arms extend from the contact base in an arm direction. The electrical terminal assembly includes a spring member supported on the contact member. The spring member includes a spring base. A plurality of spring arms extend from the spring base in the arm direction. The spring arms engage the plurality of contact arms. The spring member includes a shroud. The shroud extends in the arm direction around and beyond the contact arms. A shroud extension extends from the shroud opposite the arm direction. The shroud extension engages the contact base.

In another embodiment, the contact base defines a slot. Additionally, a shroud extension is located in the slot on the contact base.

In another embodiment, a shroud extension extends opposite the arm direction and engages a first outer surface, a second outer surface, and a third outer surface of the contact base. Also, a second shroud extension engages the first outer surface, the third outer surface, and a fourth outer surface of the contact base.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
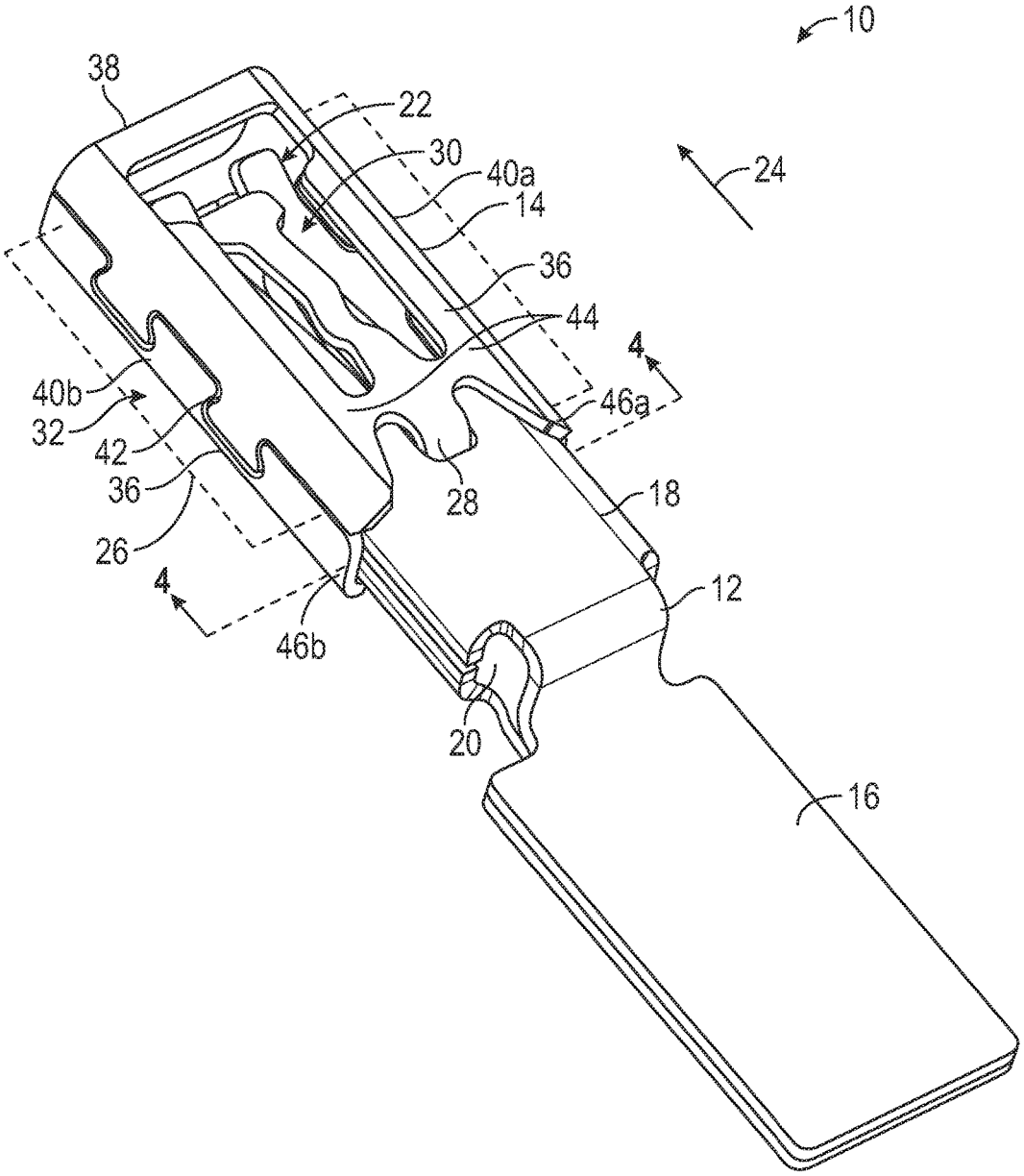
FIG. 1 is a perspective view of a first embodiment of an electrical terminal with a stabilized spring.
Figure 2:
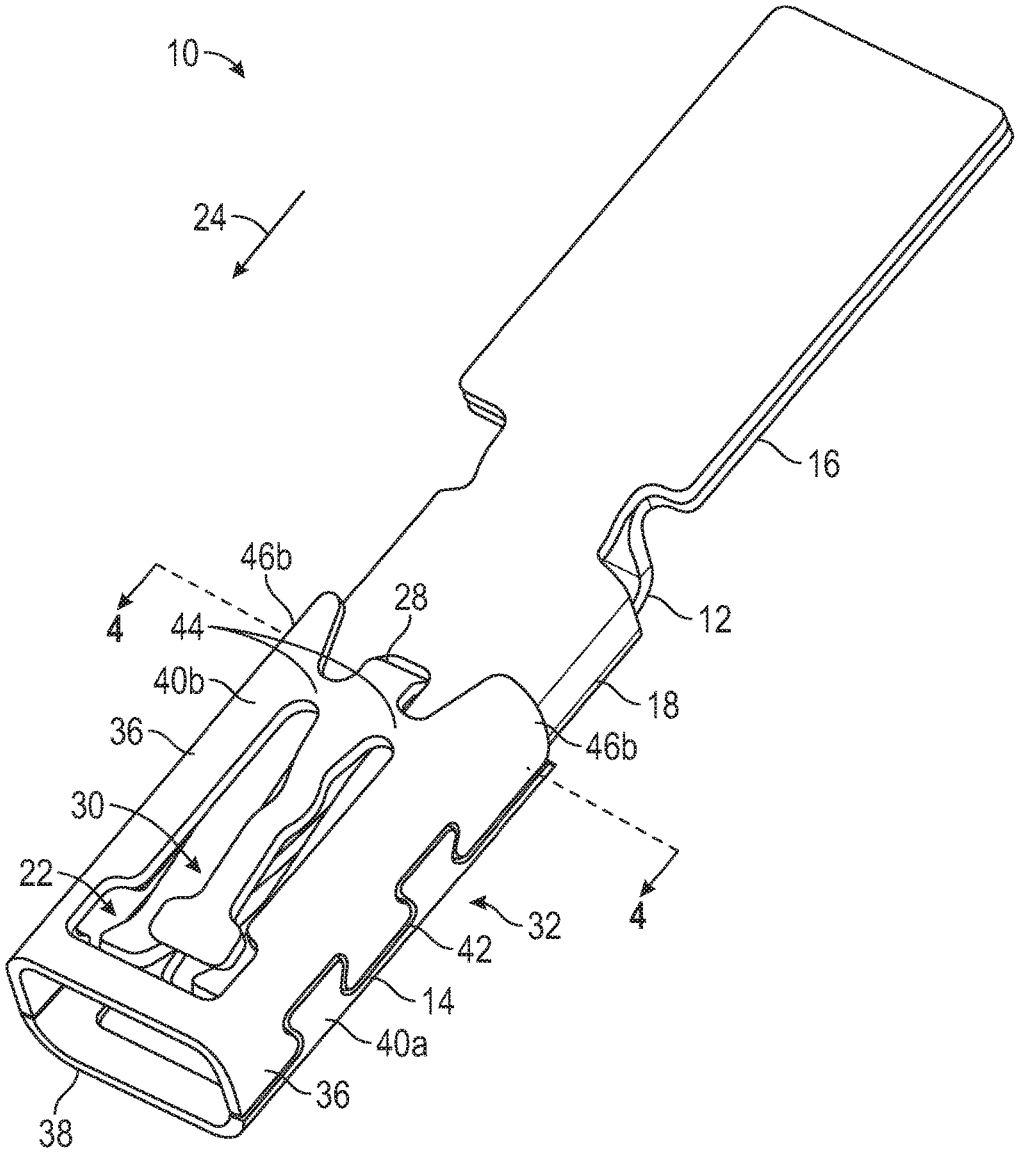
FIG. 2 is a perspective view of the electrical terminal from FIG. 1, shown from below.
Figure 3:
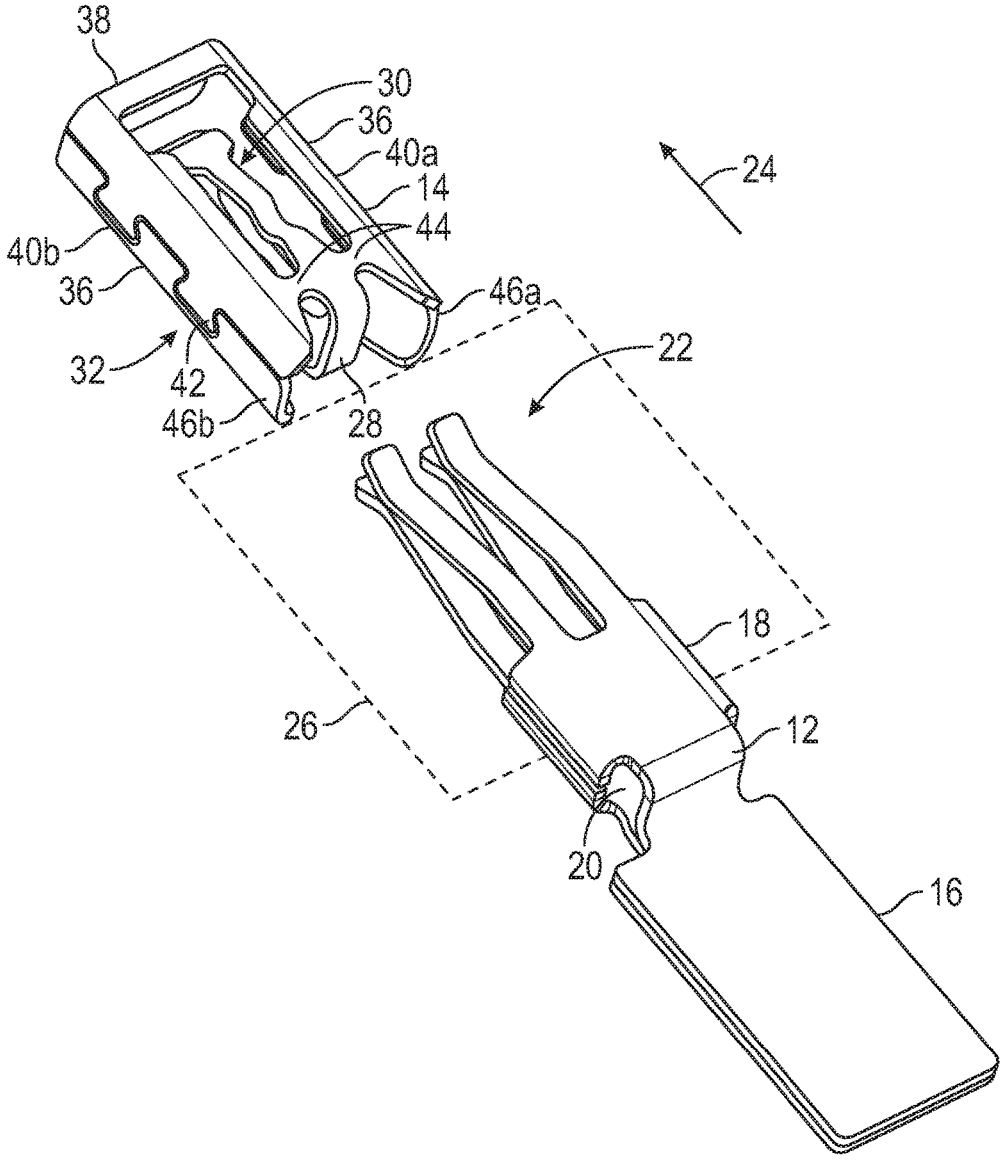
FIG. 3 is an exploded, perspective view of the electrical terminal from FIG. 1, showing a spring member separate from a contact member.

Referring now to the drawings, there is illustrated in FIG. 1 a first embodiment of an electrical terminal assembly, indicated generally at 10, in accordance with this invention. The illustrated electrical terminal assembly 10 is a female electrical terminal, but may be any desired type of terminal. The electrical terminal assembly 10 includes a contact member, indicated generally at 12, and a spring member, indicated generally at 14. FIG. 2 is a perspective view of the electrical terminal assembly 10, taken from below. FIG. 3 is a view similar to FIG. 1, showing the electrical terminal assembly 10 exploded with contact member 12 and the spring member 14 separated from each other. Details of the electrical terminal assembly 10 will be described in reference to these figures.

The illustrated contact member 12 is made from a single sheet of material, stamped and folded into the illustrated configuration. However, the contact member 12 may be made by any desired process. The illustrated contact member 12 is made of aluminum, but may be made of any desired material. Preferably, the contact member 12 is made of a material with good electrical conductivity, such as copper or a copper alloy.

The contact member 12 includes a connection portion 16 that is configured to be connected to a conductor such as a wire (not shown). The connection portion 16 may be configured for any desired type of connection. The contact member 12 includes a contact base 18 that is connected to the connection portion 16. The illustrated contact base 18 is a substantially rectangular cross-sectional shaped box that defines an interior space 20. However, the contact base 18 may have any desired shape.

The contact member 12 includes a plurality of contact arms, indicated generally at 22, that extend from the contact base 18 in an arm direction 24. In the illustrated embodiment, the connection portion 16 and the contact arms 22 are located on opposite sides of the contact base 18, but the components may have any desired relative orientations. The contact arms 22 are arranged on opposed sides of a terminal plane 26. In the illustrated embodiment, the contact member 12 includes a total of four contact arms 22 but the contact member 12 may have any desired number and arrangement of contact arms 22.

The electrical terminal assembly 10 is configured to mate with a corresponding terminal (not shown). In the illustrated embodiment, the corresponding terminal is a blade-type male terminal. However, the electrical terminal assembly 10 may be configured to mate with any desired type of corresponding terminal. When the electrical terminal assembly 10 is mated with the corresponding terminal, the corresponding terminal will be located on the terminal plane 26, between the contact arms 22.

The illustrated spring member 14 is made from a single sheet of material, stamped and folded into the illustrated configuration. However, the spring member 14 may be made by any desired process. The illustrated spring member 14 is made of stainless steel, but may be made of any desired material. Preferably, the spring member 14 is made of a material with good spring characteristics even at relatively high temperatures.

The spring member 14 includes a spring base 28. In the illustrated embodiment, when the electrical terminal assembly 10 is assembled (as shown in FIG. 1), the spring base 28 is located at least partially in the interior space 20 of the contact base 18. The spring member 14 includes a plurality of spring arms, indicated generally at 30, that extend from the spring base 28 in the arm direction 24. The spring arms 30 are arranged on opposed sides of the terminal plane 26. In the illustrated embodiment, the spring member 14 includes two spring arms 30 but the spring member 14 may have any desired number and arrangement of spring arms 30.

The spring member 14 includes a shroud, indicated generally at 32. The shroud 32 serves to protect the contact arms 22 and extends around and beyond the contact arms 22 when the electrical terminal assembly 10 is assembled. The illustrated shroud 32 includes two side shields 36 that are located on opposed sides of the contact arms 22, and pass through the terminal plane 26. The illustrated shroud 32 also includes an end shield 38 that is located beyond the contact arms 22 in the arm direction 24. The illustrated shroud 32 includes a first shroud portion 40*a* and a second shroud portion 40*b* that are substantially located on opposed sides of the terminal plane 26. In the illustrated embodiment, approximately half of each side shield 36 is located on the first shroud portion 40*a* and the other half is located on the second shroud portion 40*b*. Additionally, half of the end shield 38 is located on the first shroud portion 40*a* and the other half is located on the second shroud portion 40*b*. However, the shroud 32 may have a different configuration or arrangement of parts from that illustrated, if desired.

The first shroud portion 40*a* and the second shroud portion 40*b* are connected together by locks 42 on the side shields 36. The illustrated locks 42 are dovetail locks, but may be any desired connection.

The shroud 32 is connected to the spring base 28 by a plurality of shroud connectors 44. The illustrated shroud 32 includes four shroud connectors 44, two on either side of the terminal plane 26 and each shroud portion 40*a* and 40*b* is connected to the spring base 28 by two shroud connectors 44. The illustrated shroud connectors 44 extend from the spring base 28 to the shroud 32 substantially parallel to the terminal plane 26 and are located adjacent to the contact base 18 when the electrical terminal assembly 10 is assembled. However, the shroud connectors 44 may have any desired orientation and positioning.

The shroud 32 includes a first shroud extension 46*a* and a second shroud extension 46*b*. The shroud extensions 46*a* and 46*b* engage the contact base 18 to stabilize the spring member 14 relative to the contact member 12. The shroud extensions 46*a* and 46*b* extend from the side shields 36 opposite the arm direction 24. The illustrated shroud extensions 46*a* and 46*b* extend past the shroud connector 44 opposite the arm direction 24. Additionally, the illustrated shroud extensions 46*a* and 46*b* extend opposite the arm direction 24 past the spring base 28.

Figure 4:
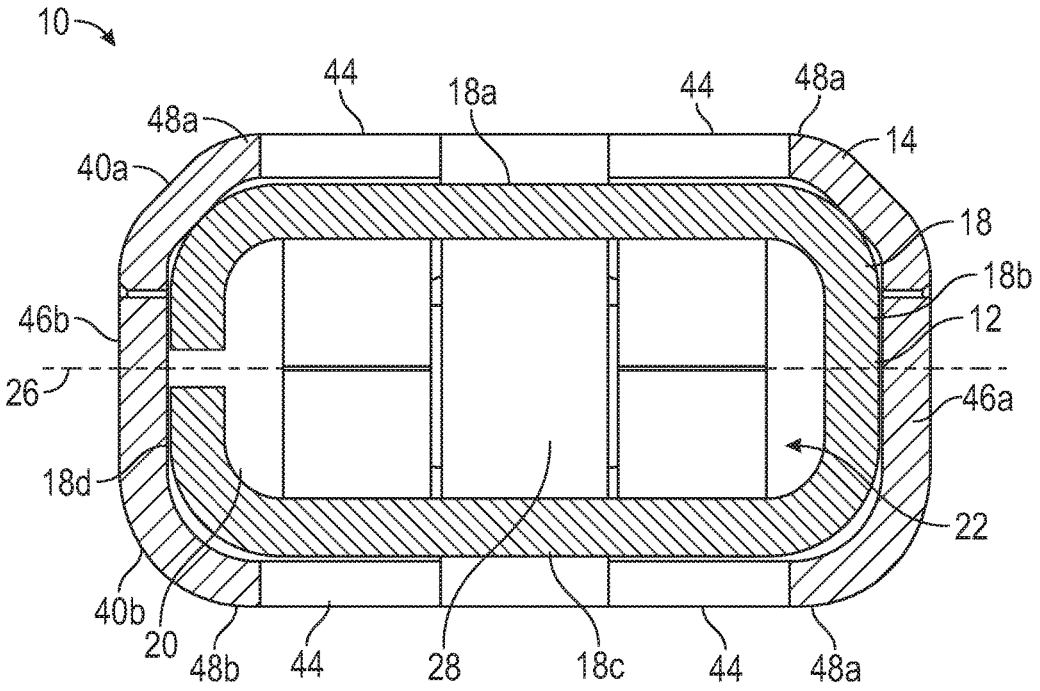
FIG. 4 is a cross-sectional view taken along the line 4-4 of FIG. 1.

Referring to FIG. 4, a cross-sectional view taken along the line 4-4 of FIG. 1 is illustrated. The cross-section shows the contact base 18 and the shroud extensions 46*a* and 46*b*. As previously-described, the contact base 18 has a generally rectangular box-shape. The illustrated contact base 18 has rounded corners, but the contact base 18 may have any desired shape. The first shroud extension 46*a* includes flanges 48*a* and engages a first side 18*a*, a second side 18*b*, and a third side 18*c* of the contact base 18. The second shroud extension 46*b* includes flanges 48*b* and engages the first side 18*a*, the third side 18*c*, and a fourth side 18*d* of the contact base 18. By engaging multiple sides of the contact base 18, the shroud extensions 46*a* and 46*b* are better able to stabilize the spring member 14 relative to the contact member 12.

Figure 5:
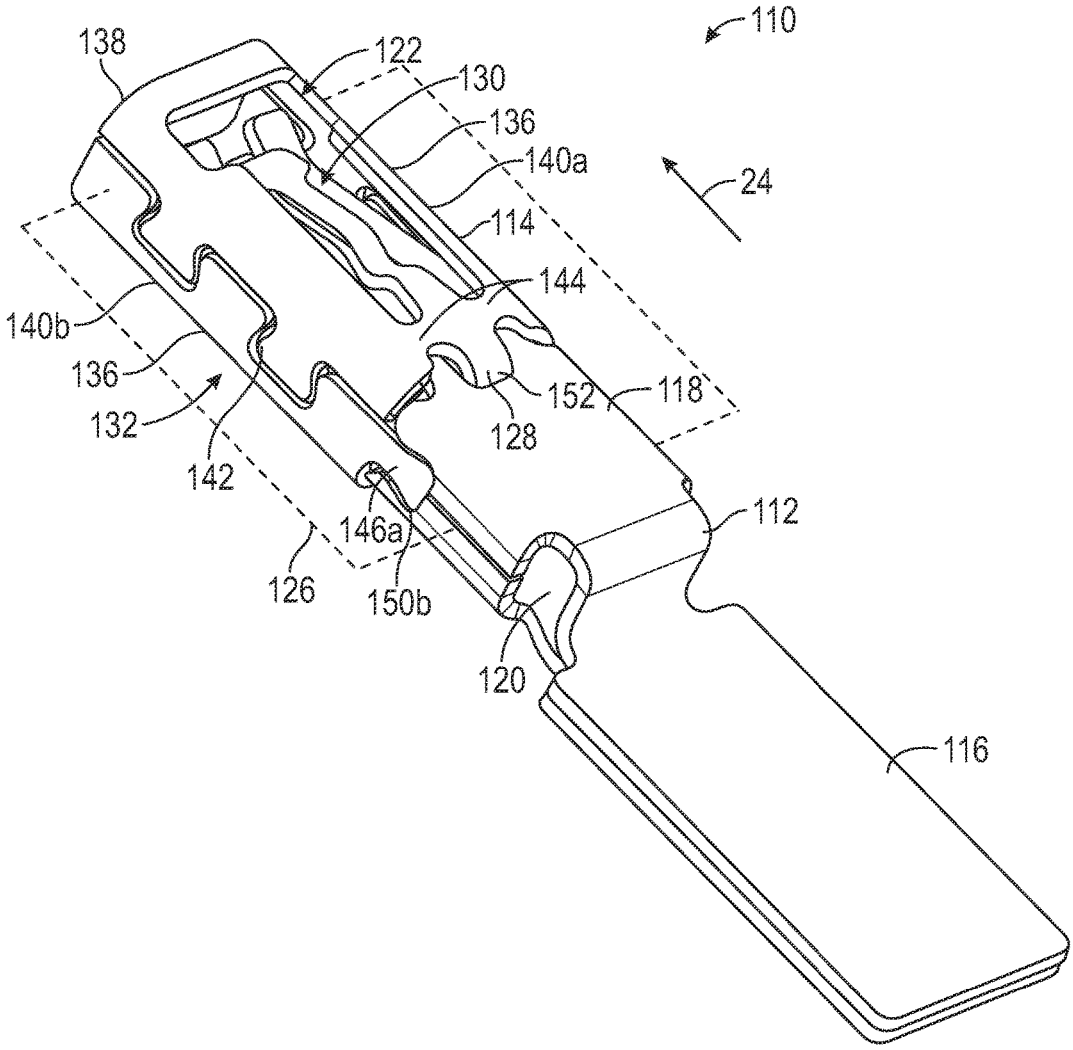
FIG. 5 is a perspective view of a second embodiment of an electrical terminal with a stabilized spring.
Figure 6:
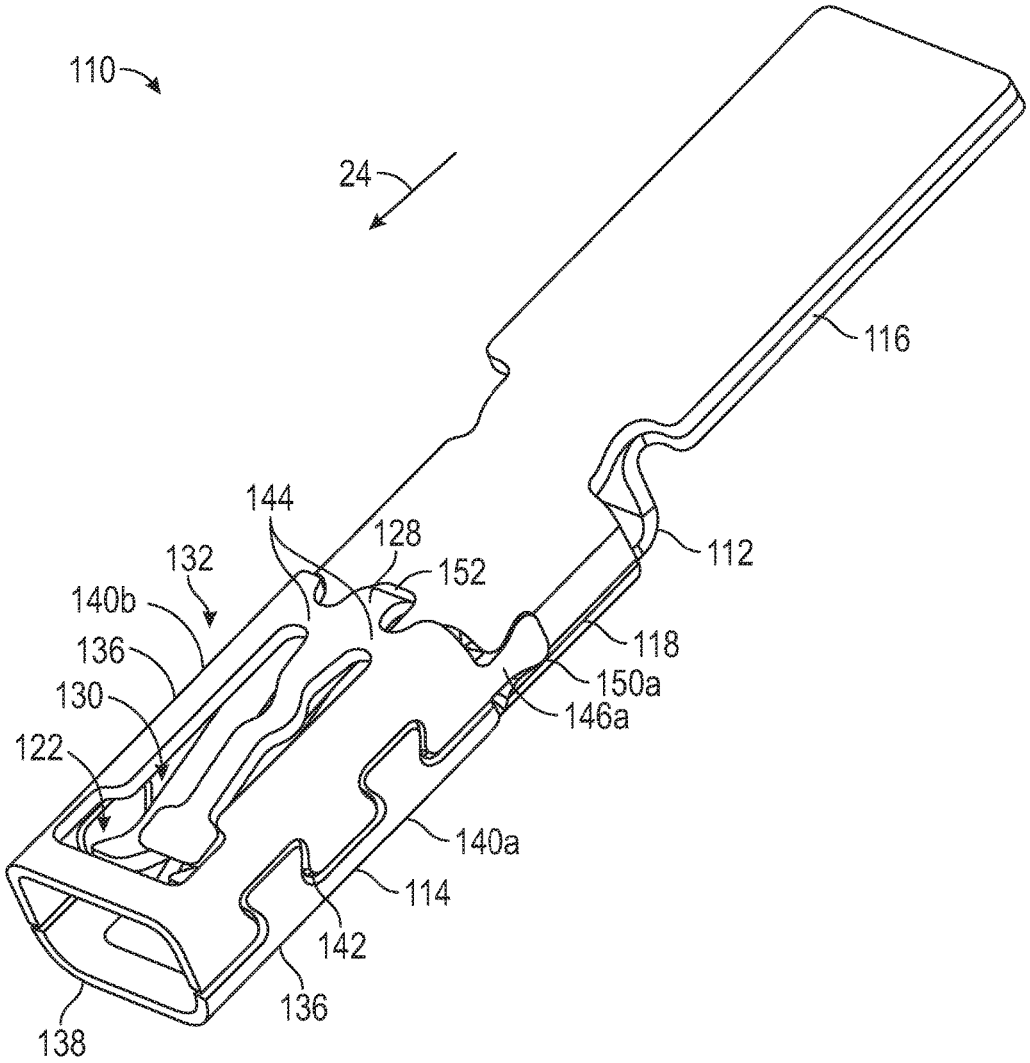
FIG. 6 is a perspective view of the electrical terminal from FIG. 5, shown from below.
Figure 7:
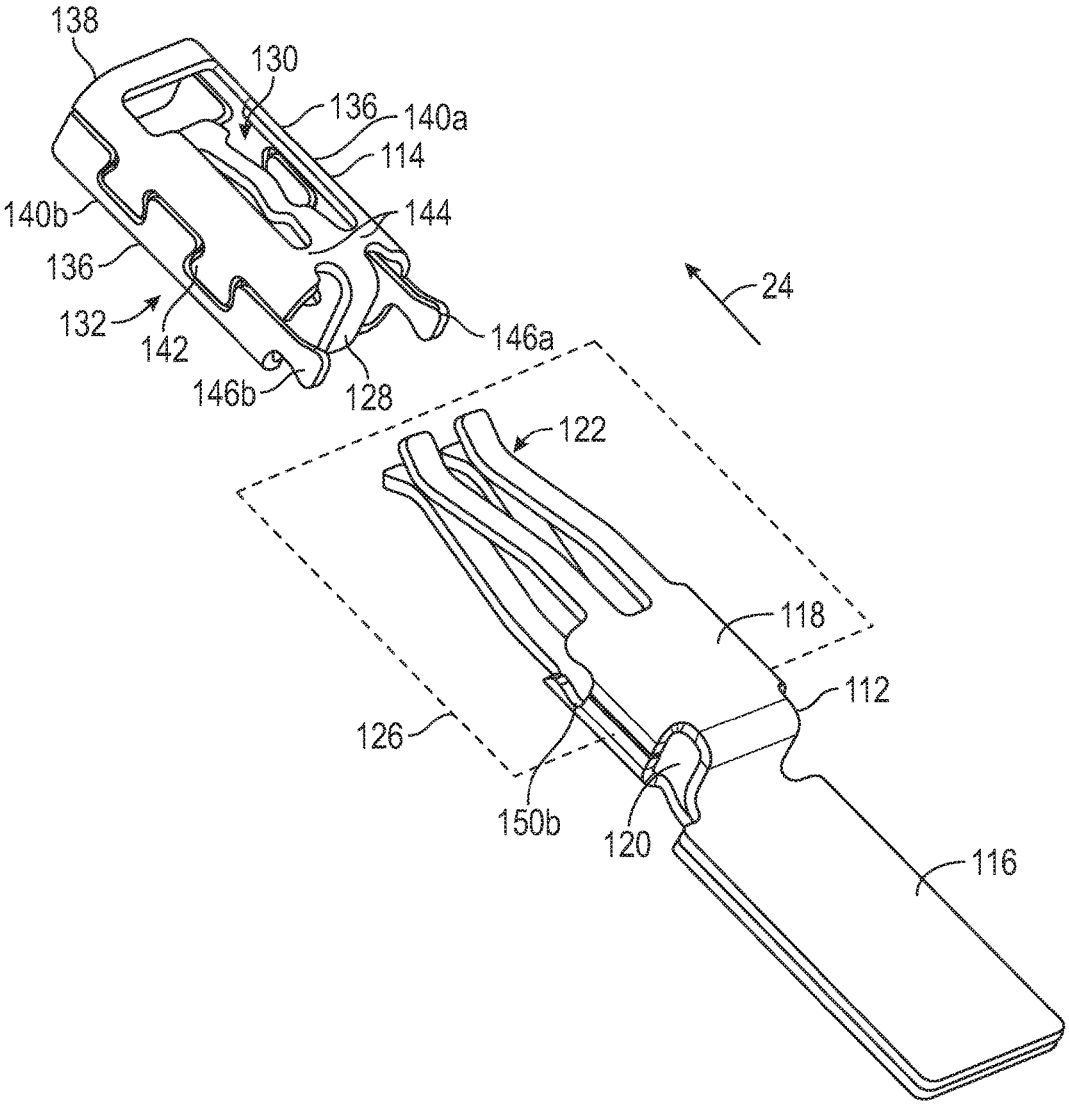
FIG. 7 is an exploded, perspective view of the electrical terminal from FIG. 5, showing a spring member removed from a contact member.

Referring to FIG. 5, there is illustrated a perspective view of a second embodiment of an electrical terminal assembly, indicated generally at 110, in accordance with this invention. FIG. 6 is a perspective view of the electrical terminal assembly 110 taken from below, and FIG. 7 is a view similar to FIG. 5, showing the electrical terminal assembly 110 exploded. The electrical terminal assembly 110 is substantially the same as the previously-described electrical terminal assembly 10. Similar features are identified by the same reference number increased by 100 and will not be described in detail.

The electrical terminal assembly 110 includes a shroud 132. The shroud 132 includes a first shroud extension 146*a* and a second shroud extension 146*b*. The shroud extensions 146*a* and 146*b* engage a contact base 118 to stabilize a spring member 114 relative to a contact member 112. The shroud extensions 146*a* and 146*b* extend from side shields 136 opposite an arm direction 124. The illustrated shroud extensions 146*a* and 146*b* are tapered projections that extend opposite the arm direction 124.

The contact base 118 defines a first slot 150*a* and a second slot 150*b* on opposed sides of the contact base 118. The first shroud extension 146*a* is located in the first slot 150*a* and the second shroud extension 146*b* is located in the second slot 150*b*. In the illustrated embodiment, a terminal plane 126 passes through the first slot 150*a* and the second slot 150*b*. Additionally, the first shroud extension 146*a* and the second shroud extension 146*b* are located at least partially on the terminal plane.

The electrical terminal assembly 110 includes an optional space 152 between a spring base 128 and the contact base 118. The space 152 allows the first shroud extension 146*a* to be positioned in the first slot 150*a* and the second shroud extension 146*b* to be positioned in the second slot 150*b* without the spring base 128 engaging the contact base body 118 and controlling control the positioning of the spring member 114 relative to the contact member 112.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical terminal assembly comprising:

a contact member including a contact base that defines an interior space and a plurality of contact arms that extends from the contact base in an arm direction; and a spring member supported on the contact member and including a spring base that extends through the interior space, a plurality of spring arms that extends from the spring base in the arm direction and engages the plurality of contact arms, a shroud that extends in the arm direction around and beyond the contact arms, and a shroud extension that extends from the shroud opposite the arm direction and engages the contact base.

2. The electrical terminal assembly of claim 1, wherein the shroud includes a shroud connector that extends from the spring base to the shroud, the shroud extension extending opposite the arm direction past the shroud connector.

3. The electrical terminal assembly of claim 2, wherein the shroud extension extends opposite the arm direction past the spring base.

4. The electrical terminal assembly of claim 1, wherein the shroud extension extends opposite the arm direction past the spring base.

5. The electrical terminal assembly of claim 1, wherein the shroud extends from the spring base in the arm direction, and the shroud extension extends from the spring base opposite the arm direction.

6. The electrical terminal assembly of claim 5, wherein the shroud extension engages a first outer surface, a second outer surface, and a third outer surface of the contact base.

7. The electrical terminal assembly of claim 6, wherein the shroud includes a second shroud extension that engages the first outer surface, the third outer surface, and a fourth outer surface of the contact base.

8. The electrical terminal assembly of claim 1, wherein the contact base defines a slot, and wherein the shroud extension is located in the slot.

9. The electrical terminal assembly of claim 8, wherein the spring arms are located on opposed sides of a terminal plane, and the shroud extension is located on the terminal plane.

10. The electrical terminal assembly of claim 9, wherein the shroud includes a second shroud extension that is located in a second slot on the contact base.

11. The electrical terminal assembly of claim 10, wherein the second shroud extension is located on the terminal plane.

12. An electrical terminal assembly comprising:

a contact member including a contact base that defines an interior space and a plurality of contact arms that extends from the contact base in an arm direction, the contact base defining a slot; and a spring member supported on the contact member and including a spring base that extends through the interior space, a plurality of spring arms that extends from the spring base in the arm direction and engages the plurality of contact arms, a shroud that extends in the arm direction around and beyond the contact arms, and a shroud extension that extends from the shroud opposite the arm direction and is located in the slot on the contact base.

13. The electrical terminal assembly of claim 12, wherein the plurality of spring arms are located on opposed sides of a terminal plane, and wherein the shroud extension is located on the terminal plane.

14. The electrical terminal assembly of claim 13, wherein the shroud includes a second shroud extension that is located in a second slot on the contact base.

15. The electrical terminal assembly of claim 14, wherein the second shroud extension is located on the terminal plane.

16. The electrical terminal assembly of claim 15, wherein the shroud extension and the second shroud extension each extend opposite the arm direction past the spring base.

17. An electrical terminal assembly comprising:

a contact member including a contact base that defines an interior space and first and second opposed contact arms that extend from the contact base in an arm direction; and a spring member including a spring base that extends through the interior space, first and second opposed spring arms that extend from the spring base in the arm direction and respectively engage the first and second opposed contact arms, a shroud that extends in the arm direction around and beyond the contact arms, and a shroud extension that extends from the shroud opposite the arm direction and engages the contact base.

18. The electrical terminal assembly of claim 17, wherein the shroud extends from the spring base in the arm direction, and the shroud extension extends from the spring base opposite the arm direction.

19. The electrical terminal assembly of claim 17, wherein the contact member includes first and second opposed pairs of contact arms that extend from the contact base in an arm direction, and wherein the spring base extends through the interior space between the first and second opposed pairs of contact arms.

20. The electrical terminal assembly of claim 17, wherein the shroud includes a shroud connector that extends from the spring base to the shroud, the shroud extension extending opposite the arm direction past the shroud connector.

* * * * *